US008636534B2

(12) United States Patent
Zhu

(10) Patent No.: US 8,636,534 B2
(45) Date of Patent: Jan. 28, 2014

(54) CARD EDGE CONNECTOR WITH IMPROVED BOARD-RETAINING MEMBER AND ASSEMBLY OF THE SAME

(75) Inventor: Jian-Kuang Zhu, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/586,897

(22) Filed: Aug. 16, 2012

(65) Prior Publication Data

US 2013/0045619 A1 Feb. 21, 2013

(51) Int. Cl.
*H01R 13/62* (2006.01)

(52) U.S. Cl.
USPC ..... 439/328; 439/541.5

(58) Field of Classification Search
USPC ..... 439/325–328, 350–352, 630, 541.5
See application file for complete search history.

(56) References Cited

U.S. PATENT DOCUMENTS 5,997,332 A * 12/1999 Choy ..... 439/328
6,319,035 B1 * 11/2001 Choy ..... 439/326
7,828,580 B2 * 11/2010 Zhu et al. ..... 439/352
2002/0082729 A1 * 6/2002 Tsao ..... 700/90
2006/0094277 A1 * 5/2006 Yang et al. ..... 439/328
2009/0156047 A1 * 6/2009 Zhu et al. ..... 439/352
2011/0039454 A1 * 2/2011 Zhu et al. ..... 439/680

FOREIGN PATENT DOCUMENTS

TW 551567 9/2003

* cited by examiner

*Primary Examiner* — Dac D Ta
*Assistant Examiner* — Larisa Tsukerman
(74) *Attorney, Agent, or Firm* — Wei Te Chung; Ming Chieh Chang

(57) ABSTRACT

A card edge connector comprises an insulative housing defining an inserting slot along a longitudinal direction thereof and a key lying in the inserting slot; a plurality of contacts retained in the insulative housing, the contacts including retaining portions retained in the insulative housing, soldering portions extending from the retaining portions and contacting portions extending from the retaining portion and located at two sides of the inserting slot; a pair of locking members disposed at two opposite ends of the insulative housing in the longitudinal direction and perpendicularly to the insulating housing; and a pair of the board-retaining members retained on two opposite ends of the insulative housing or the locking members in the longitudinal direction, the board-retaining members comprising board-retaining portions bending inward and approaching to the soldering portions of two outermost contacts along the longitudinal direction of the insulating housing.

11 Claims, 10 Drawing Sheets

CARD EDGE CONNECTOR WITH IMPROVED BOARD-RETAINING MEMBER AND ASSEMBLY OF THE SAME

BACKGROUND OF THE INVENTION

1. Field of the Invention

The present invention relates to a card edge connector and an assembly of the same which have improved board-retaining member for miniaturization.

2. Description of the Related Art

TW Pat. Publication No. 551567 discloses a card edge connector in a stacked statue. The card edge connectors define a higher electrical connector and a lower electrical connector retaining at the underside of the higher electrical connector. Each connector defines a longitudinal insulative housing and a plurality of contacts retained in the insulative housing, a pair of locking members respectively disposed and detachably secured on two opposite ends of the insulative housing and a retaining member retained in the locking members. The retaining member makes the insulative housing and the locking members retain on a PCB on which the card edge connector is mounted. The retaining member of the higher electrical connector is of an L-shape, which bending outwards to comfortably contain the lower electrical connector. The outward retaining member will occupy more space on the PCB which will not meet miniaturization especially when two card edge connectors are set closer to another.

Hence, a new design of a card edge electrical connector which can solve the above problem to adapt to the trend of miniaturization is needed.

SUMMARY OF THE INVENTION

Accordingly, an object of the present invention is to provide an card edge connector to meet a trend of miniaturization.

In order to achieve the object set forth, the invention relations a card edge connector and the assembly. The card edge connector comprises an insulative housing defining an inserting slot along a longitudinal direction thereof and a key lying in the inserting slot; a plurality of contacts retained in the insulative housing, the contacts including retaining portions retained in the insulative housing, soldering portions extending from the retaining portions and contacting portions extending from the retaining portion and located at two sides of the inserting slot; a pair of locking members disposed at two opposite ends of the insulative housing in the longitudinal direction and perpendicularly to the insulating housing; and a pair of the board-retaining members retained on two opposite ends of the insulative housing or the locking members in the longitudinal direction, the board-retaining members comprising board-retaining portions bending inward and approaching to the soldering portions of two outermost contacts along the longitudinal direction of the insulating housing.

Other objects, advantages and novel features of the invention will become more apparent from the following detailed description of the present embodiment when taken in conjunction with the accompanying drawings.

DETAILED DESCRIPTION OF THE INVENTION

Figure 1:
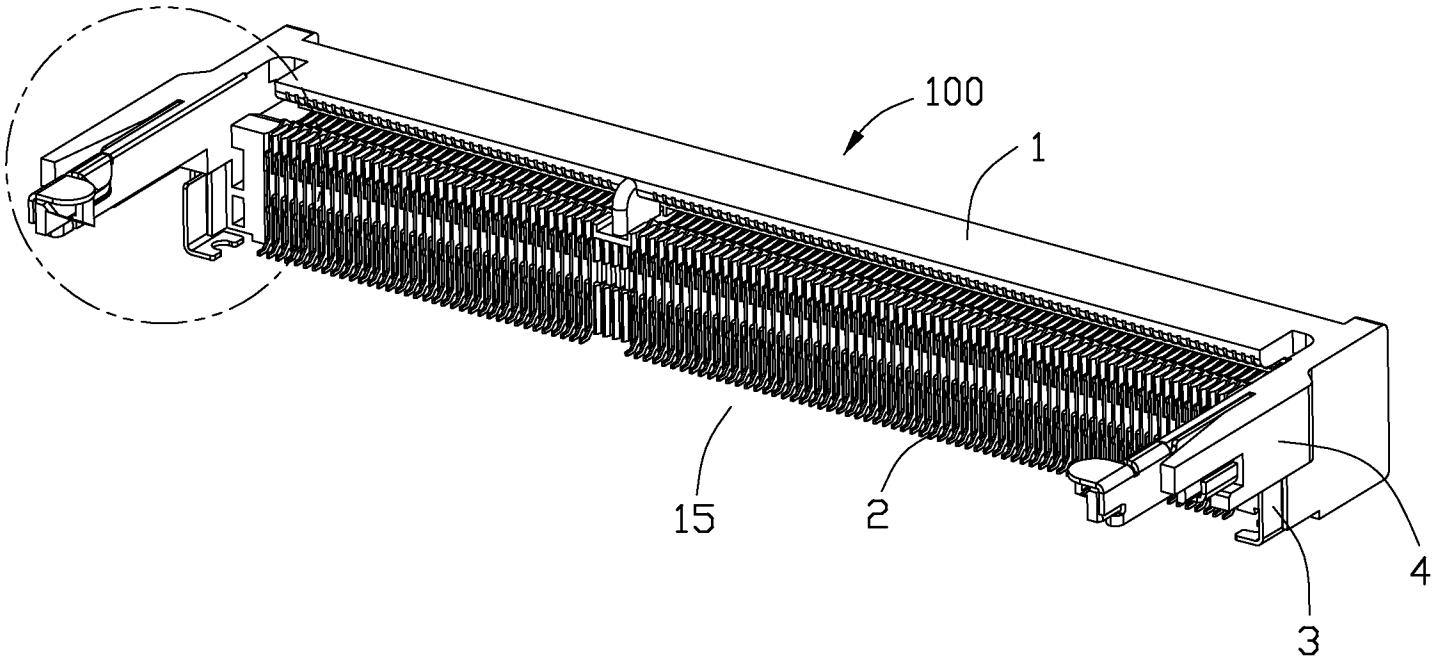
FIG. 1 is a perspective view of a card edge connector of a first embodiment of the present invention.

Reference will now be made to the drawing figures to describe a preferred embodiment of the present invention in detail.

Referring to FIG. 1, a higher card edge connector 100 in a higher profile of the present invention mainly defines a longitudinal insulative housing 1, a plurality of contacts 2 retained in the insulative housing 1, a pair of board-retaining members 3 assembled in two opposite ends of the insulative housing 1 respectively and a pair of locking members 4 detachably disposed at two opposite ends of the insulative housing 1.

Figure 2:
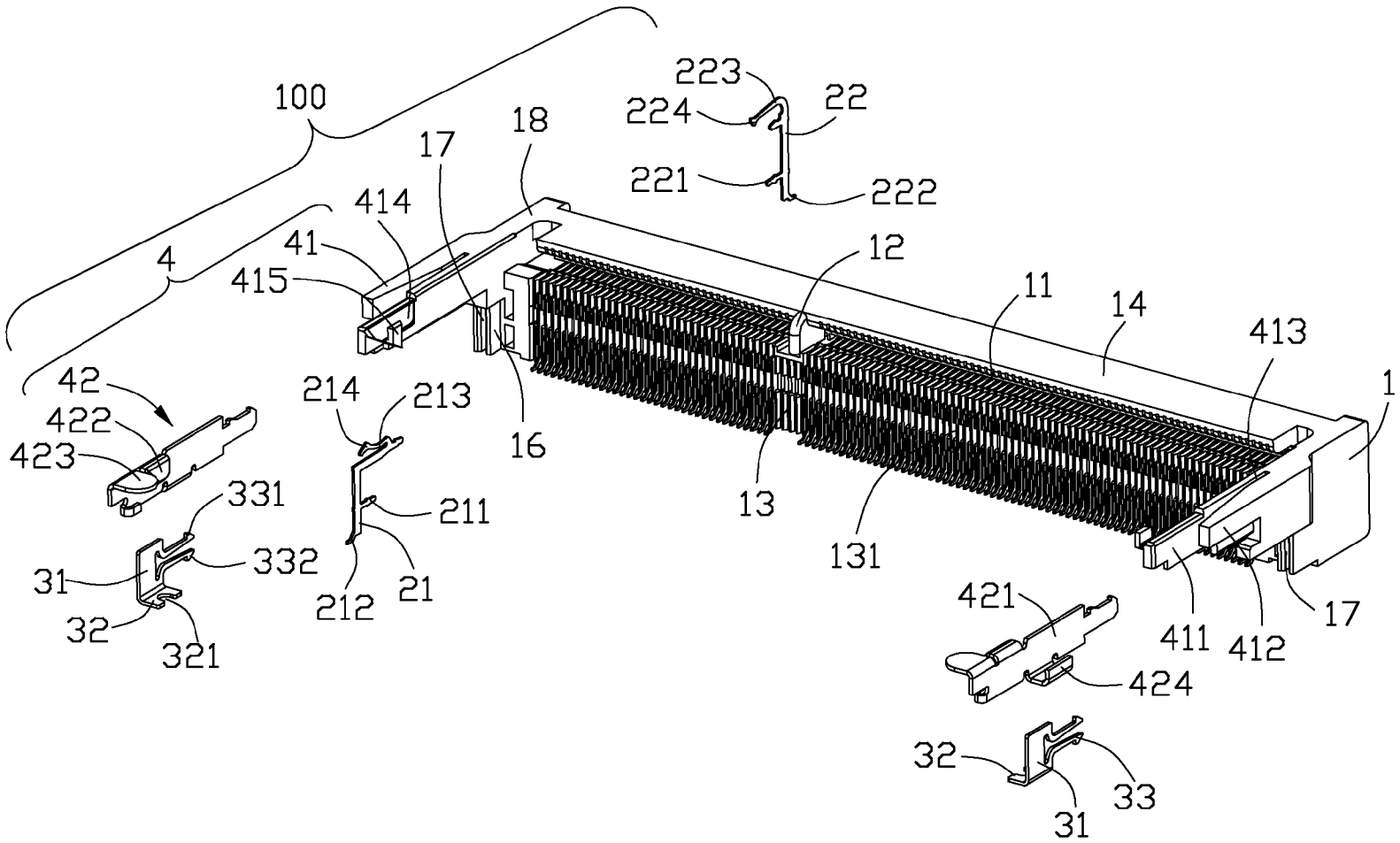
FIG. 2 is a partly exploded view of the card edge connector shown in FIG. 1.
Figure 3:
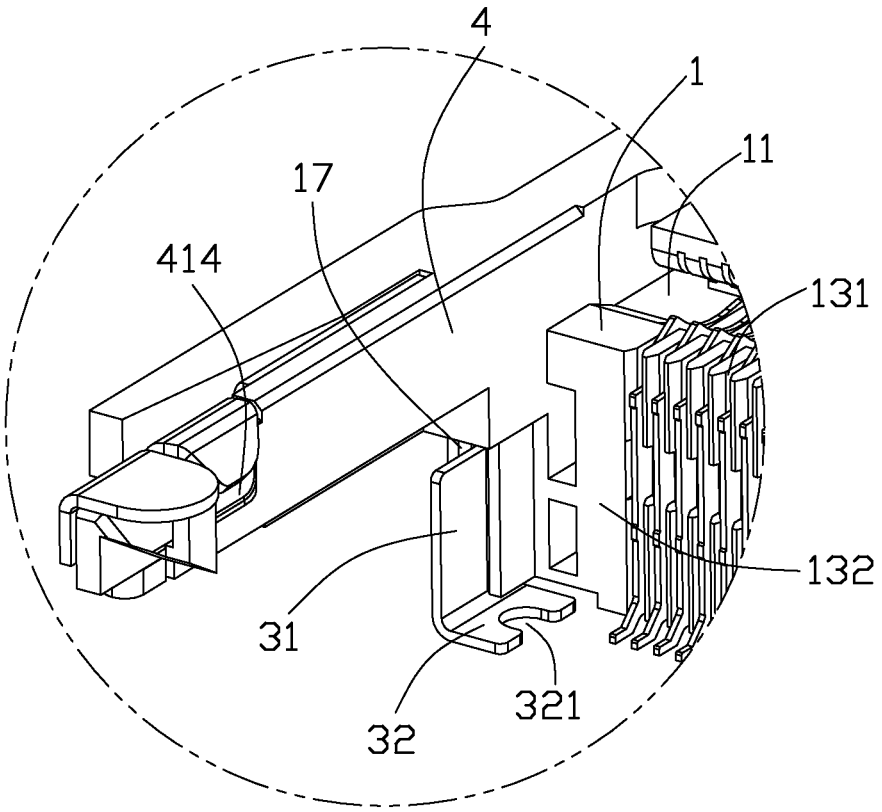
FIG. 3 is an amplificatory view of part of the connector in the circle shown in FIG. 1.

Referring to FIG. 2, the insulative housing 1 defines an inserting slot 11 along a longitudinal direction thereof between a first bottom wall 13 and a second upper wall 14 and a key 12 lying in the inserting slot 11 for preventing from mis-mating of a mating card into the inserting slot 11, the first bottom wall 13 defines a plurality of first receiving passages 131 along the front surface 132 (labeled in FIG. 3). The second wall 14 also is formed with second receiving passages (not labeled).

The contacts 2 comprise a row of first contacts 21 retained in the first receiving passages 131 and a row of second contacts 22 retained in the second receiving passages. Each contact includes a retaining portion retained in the insulative housing 1, a soldering portion extending from one end of the retaining portion and outside of the insulative housing 1 and a contacting portion extending from the other end of the retaining portion. The contacting portion projects into the inserting slot 11. In this embodiment, each first contact 21 includes a first retaining portion 211 piercing the insulative housing 1, a first soldering portion 212 extending from the bottom of the first retaining portion 211 and a first contacting arm 213 forward extending from the upper end of the first retaining portion 211 and locating in the inserting slot 11. Each second contact 22 includes two second retaining portions 221 piercing in the insulative housing 1, a second soldering portion 222 extending from the bottom end of the second retaining portions 221 and the second contacting arms 223 forward extending from the upper end of the second retaining portions 221. The first contacting arms 213 and the second contacting arms 223 extending in a same direction with first contacting portions 214 and second contacting portions 224 thereof exposing to the inserting slot 11 and facing to each other.

Referring to FIG. 2, the locking members 4 are respectively located at two longitudinal ends of the insulative housing 1 thereby forming a card-receiving space 15 for retaining an electrical card thereamong. The locking members 4 define a pair of plastic arms 41 extending forwardly from the end portions 18 of the insulative housing 1 and a pair of metallic arms 42 retained on the plastic arms 41. Each plastic arm 41 extends forwardly and includes a first latching arm 411 and a reinforcing or stopper arm 412 located at an outside of the first latching arm 411 and separated from the first latching arm 411 by a retained slit 413. The reinforcing arm 412 is used for preventing the first latching arm 411 from over-moving. The front end of the first latching arm 411 defines a locking portion 414 projecting inwards to the card-receiving space 15, which is in a same height level to the inserting slot 11 projecting into the card-receiving space 15, and a restricting portion 415 which coordinate with the concavity of the electrical card for preventing the electrical card moving when the electrical card be inserted. The locking portion 414 press against both sides of the electrical card and make the electrical card keeping in a horizontal position of the card-receiving space 15. The metallic arms 42 are retained in the retained slit 413 and each comprises a base portion 421 which fitly surrounds an outside of the first latching arm 411, a slanting portion 422 extending from an upper edge of the base portion 421 and covering on the locking portion 414 in order to add the strength of the locking portion 414 and guiding the electrical card inserting at the under of the locking portion 414, a leveling portion 423 extending from the upper edge of the base portion 421 and covering the upper side of the restricting portion 415 and coordinating with the concavity of the electrical card to make the electrical card inserts accurately and a blocking portion 424 which extends and bends outside from a lower edge of the base portion 421. The blocking portion 424 fitly surrounds the lower edge of the reinforcing arm 412 which will further increase the strength of the reinforcing arm 412.

Combination with FIG. 3, the pair of board-retaining members 3 are retained on two opposite ends of the insulative housing 1 and positioned under the locking members 4. Each board-retaining member 3 comprises a base portion 31, a board-retaining portion 32 extending from a bottom edge of the base portion 31 and a retained portion 33 extending rearward from the base portion 31. The board-retaining member 3 is roughly L-shaped, the board-retaining portion 32 extends to the receiving space 15 and approaches to the front surface 132 of the insulative housing 1 but not laterally exceed the first receiving passageways 131. Each board-retaining portion 32 respectively includes a notch 321 opening inwards. The retained portion 33 is a fork shaped configuration and form a first stabbing portion 331 and a second stabbing portion 332 separated from each other with an interval. The first stabbing portion 331 and the second stabbing portion 332 extend towards to the insulative housing 1 from the base portion 31 and each have a hook protruding outwardly from a distal end thereof. The insulative housing 1 further defines a pair of protruding portion 16 located under the locking members 4. The protruding portion 16 extends in a same direction as the locking members 4 and exceeds the front surface 132. The protruding portion 16 includes a connecting slot 17 therein and the connecting slot 17 extends vertically toward the locking members 4. The board-retaining members 3 are detachably retained in the connecting slot 17 and slightly floating upwardly and downwardly at the connecting slot 17. The width of the connecting slots 17 gradually become smaller from inside to front thereof. During the retained portions 33 of the board-retaining members 3 are inserted in the connecting slot 17, the first stabbing portion 331 and the second stabbing portion 332 are compressed toward each other so as to be inserted in the connecting slot 17 and then restore thereby keeping the board-retaining members 3 connecting retained in the connecting slot 17.

Figure 4:
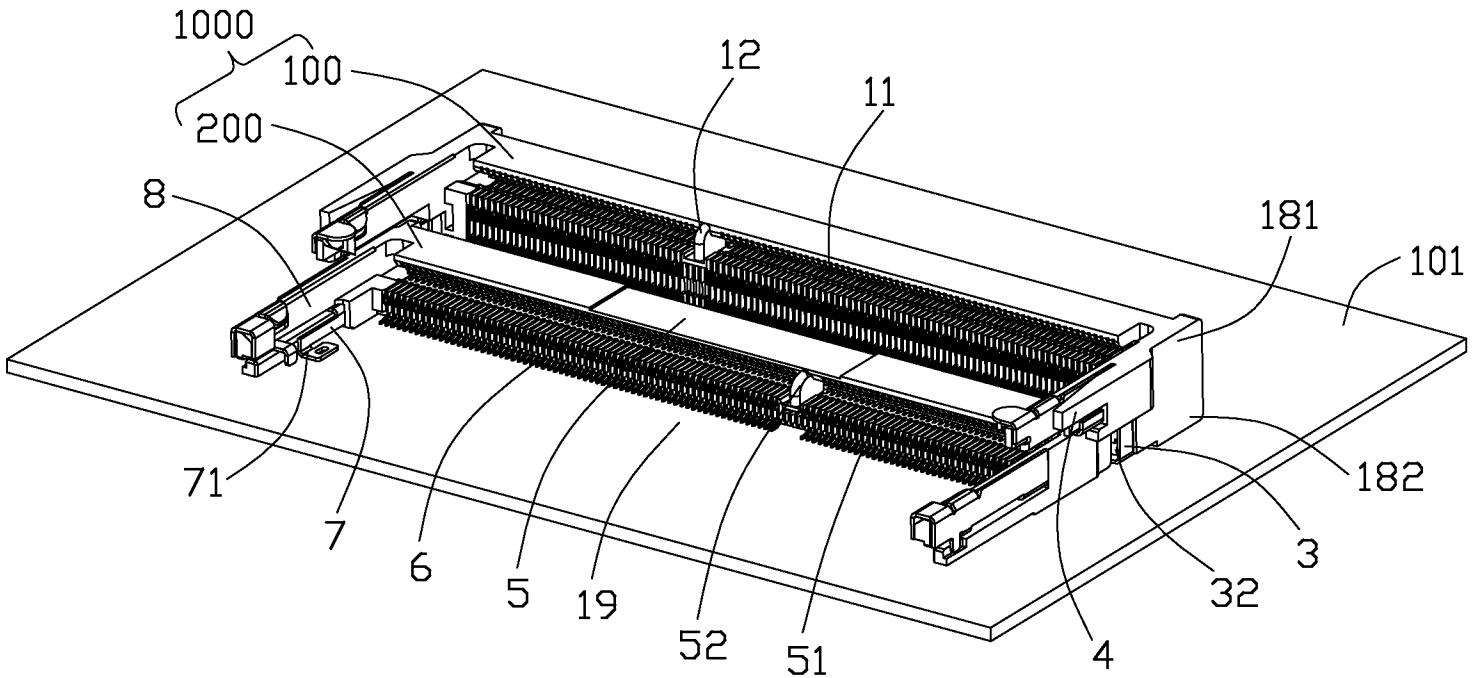
FIG. 4 is an assembled perspective view of a stacked card edge connector assembly with a lower connector contained below a higher connector mounted on a PCB.

The board-retaining portions 32 bend from the base portion 31 and extend in opposite directions. The base portions 31 disposed under the locking members 4 and the board-retaining portions 32 bend inward under a condition that the lateral edges of the board-retaining portions 32 do not arrive the nearest first contacts 21. Therefore, the board-retaining portions 32 not only make use of a blank space without any contacts but also do not occupy any space beside the locking portion 414. With this structure, the higher card edge connector 100 occupies shorter in the longitudinal direction thereof. The board-retaining portions 32 bend toward the card-receiving space 15 and are tested comfortably through one side of the card-receiving space 15. Moreover, as shown in FIG. 4, a stacked assembly 1000 is construed by the higher connector 100 containing a lower card edge connector 200 under the locking member 5 of the higher connector 200. The compact setting of the higher card edge connector 100 can save the occupied space on the electrical board 101. The inward board-retaining portions do not affect or interference the arrangement of the lower card edge connector 200.

Referring to FIG. 4, the connector assembly 1000 of the present invention is installed on the electrical board 101. The assembly 1000 includes the higher card edge connector 100 and the low card edge connector 200 stacked in a front and rear direction. The insulative housing 1 of the higher card edge connector 100 is of a higher profile type and is divided by an upper portion 181 and a lower portion 182 along a vertical direction perpendicular to the longitudinal direction thereof. The inserting slot 11 and the locking members 4 are located on the upper portion 181 so that a front cavity is defined in front of the lower portion 182 under the locking member 4. The lower card edge connector 200 has a same configuration to the higher card edge connector 100 and is contained in the front cavity. An insulative housing 5 of the lower card edge connector 200 defining a receiving slot 51 with a keying 52 in the slot and a plurality of contacts 6 along two sides of the receiving slot 51 is located in the front of the insulative housing 5 of the higher card edge connector 100. A pair of locking members 8 of the lower card edge connector 200 is located under corresponding locking members 4 of the higher card edge connector 100. A pair of board-retaining members 7 retained in the insulative housing 5 and under the locking members 8, each of which includes a board-retaining portion 71 bending inward from the inside of the locking member 8.

Figure 5:
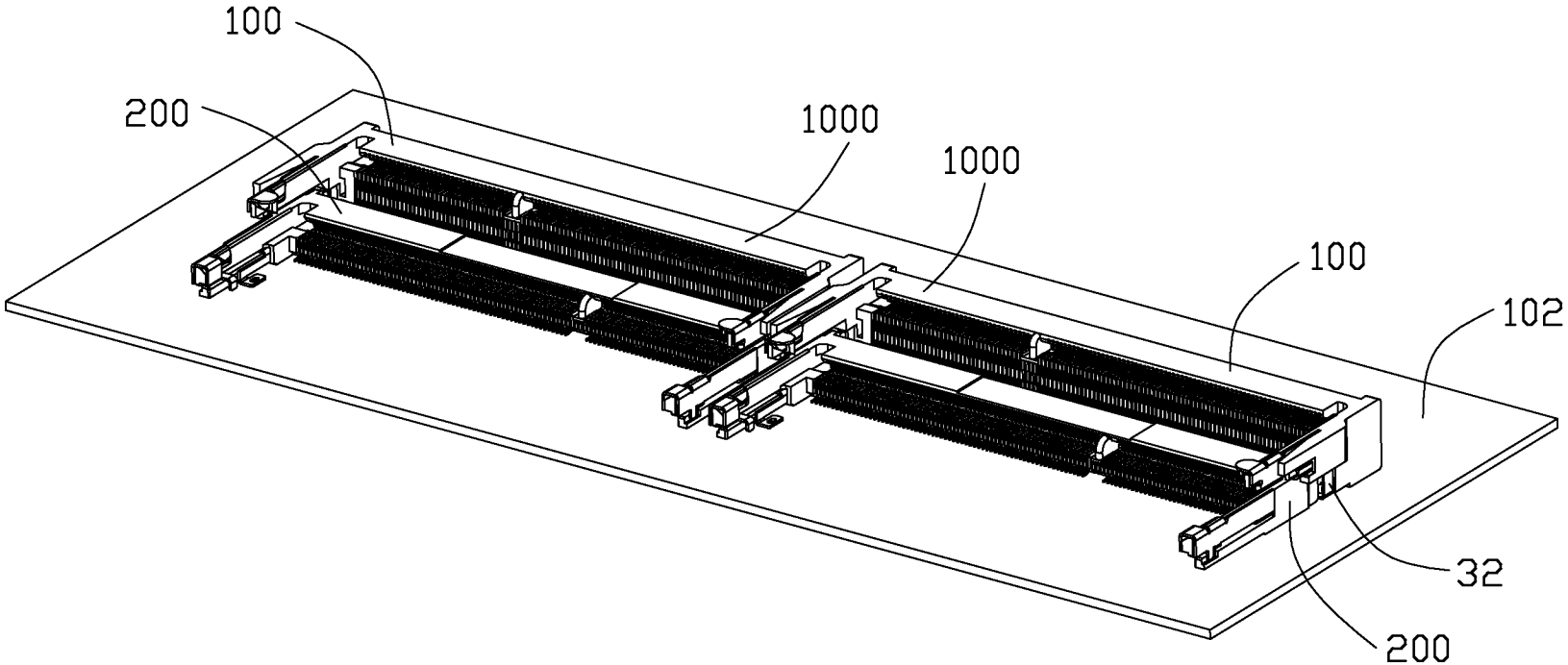
FIG. 5 is an assembled perspective view of said two stacked assembly side by side mounted on the board.
Figure 6:
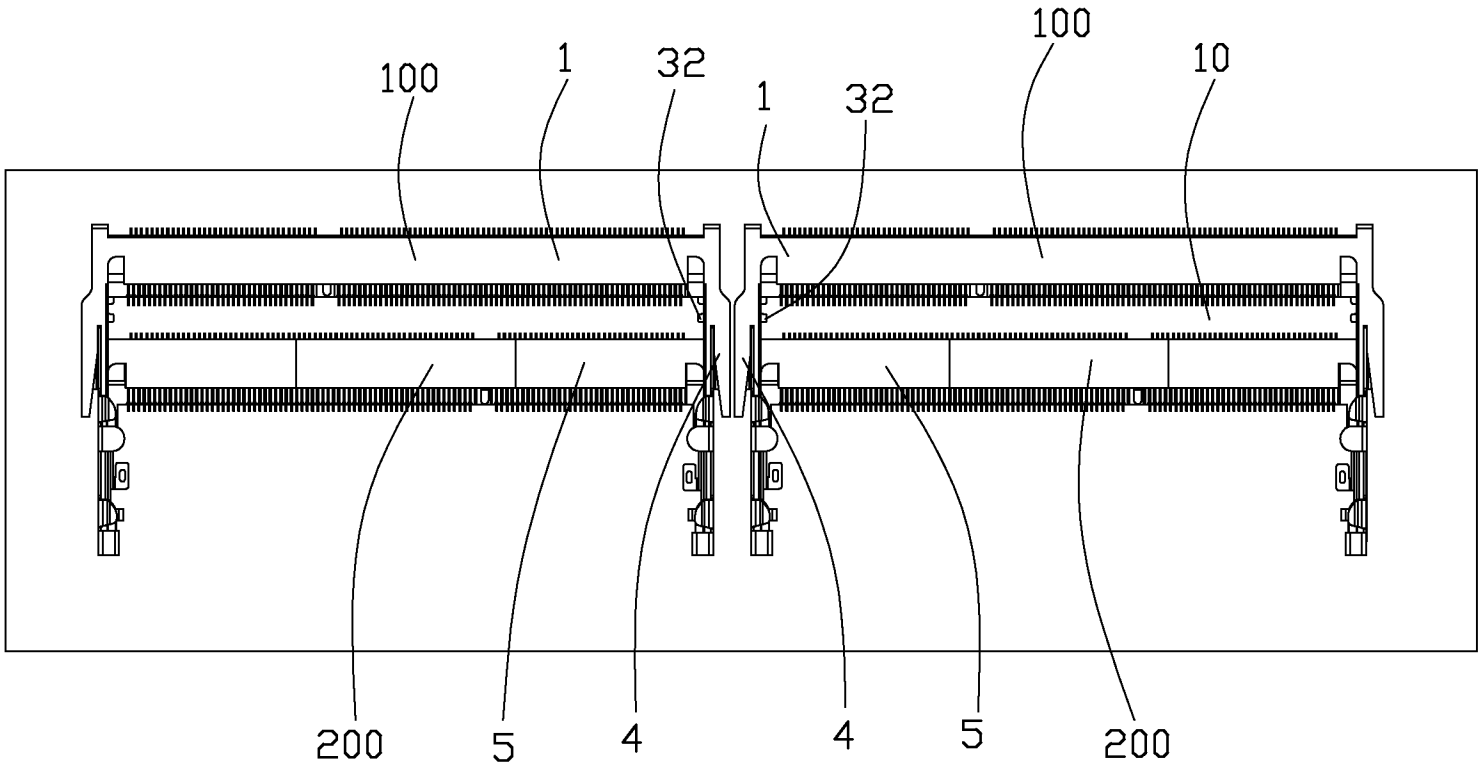
FIG. 6 is a top planar view of the assembly as shown in FIG. 5.
Figure 7:
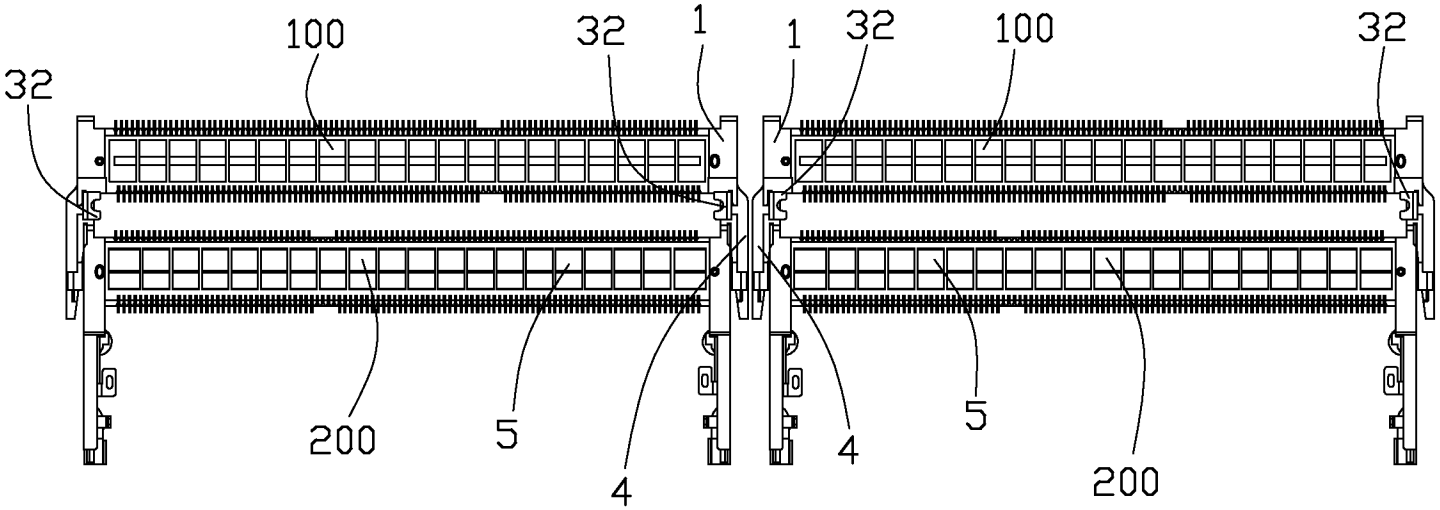
FIG. 7 is a bottom plane view of the assembly as shown in FIG. 5.

Referring to FIG. 5 to FIG. 7 illustrating two stacked connector assemblies 1000 which are mounted on the board 102 in side by side patter. It is expressly show an advantage of the structure of the higher card edge connector 100 with inward-bending board-retaining portions 32. The two assembly 1000 are aligner with each other without any offset along a longitudinal direction and the assemblies keep nearer as possibly in the longitudinal direction. As known, the outermost faces of the assembly 1000 are the outermost faces of the locking members 4 of the higher connector 100 since the locking members 4 bend inward. When the two adjacent outmost faces of the locking members 4 keep close to each other, the two assemblies 1000 get a short distance on the board 102. On the other hand, as best shown in FIG. 6, the front lower card edge connector 200 is located in front of the rear higher card edge connector 100 with a separated space 10, in which the board-retaining portions 32 are just received. One advantage is that the board-retaining portions 32 are tested and amended through this separated space 10 along the inside of the locking member 4. As shown in FIG. 7, the board-retaining portions 32 are just located between the two locking members 4.

Figure 8:
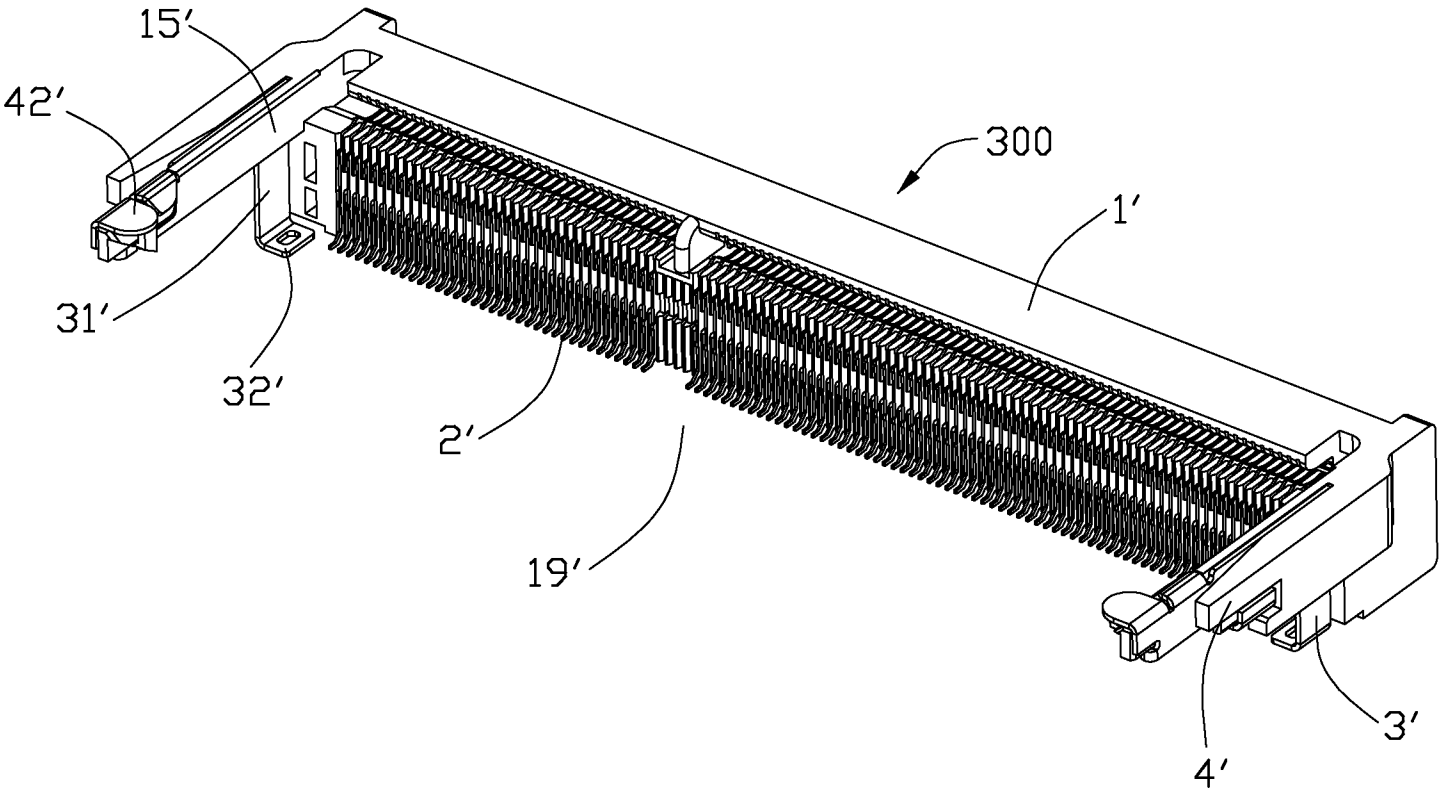
FIG. 8 is a perspective view of a card edge connector of a second embodiment of the present invention.
Figure 9:
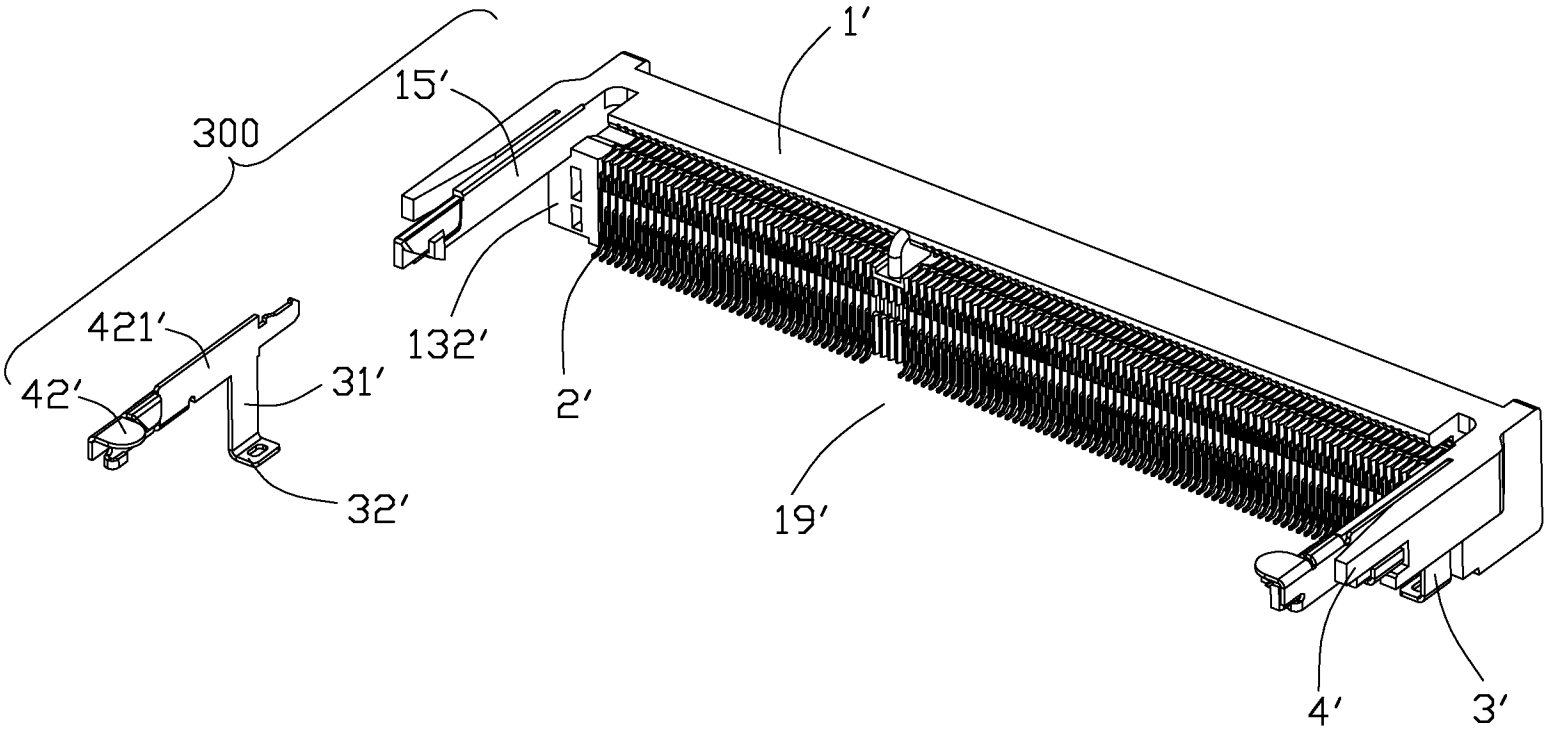
FIG. 9 is a partly exploded view of the card edge connector shown in FIG. 8.
Figure 10:
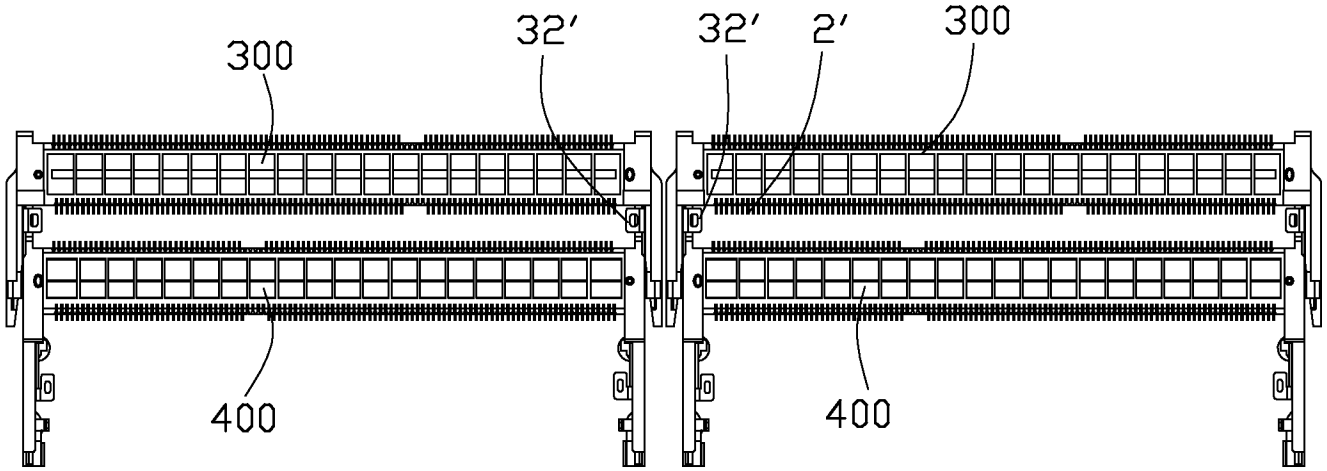
FIG. 10 is a bottom planar view of two stacked connector assembly with the card edge connector in FIG. 8.

Referring to FIG. 8 and FIG. 9 showing a second embodiment of the present invention, a higher profile card edge connector 300 is similar to the higher card edge connector 100 in structure. A pair of board-retaining members 3' of the higher connector 300 integrally extends from a pair of metallic arms 42' of a pair of locking members 4', which is distinguish to an insulating housing 1' of the higher card edge connector 100. The board-retaining members 3' includes a base 31' connecting with the metallic arms 42' and a board-retaining portions 32' bending inward from the base 31'. The board-retaining portions 32' are located in the front of the front surface 132' of the insulative housing 1' and approach to the contacts 2'. The board-retaining portions 32' do not laterally exceed the insulative housing 1' and the locking members 4'. FIG. 9 shows an arranged compactly assembly which includes two stacked assemblies arranged side by side. The stacked assembly is construed with the higher connector 300 containing a lower connector under the locking members 15 of the higher connector 300.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector comprising:

an insulative housing defining an inserting slot along a longitudinal direction thereof and a key lying in the inserting slot;

a plurality of contacts retained in the insulative housing, the contacts including retaining portions retained in the insulative housing, soldering portions extending from the retaining portions and contacting portions extending from the retaining portion and located at two sides of the inserting slot;

a pair of locking members disposed at two opposite ends of the insulative housing in the longitudinal direction and perpendicularly to the insulating housing; and a pair of the board-retaining members retained on two opposite ends of the insulative housing or the locking members in the longitudinal direction, the board-retaining members comprising board-retaining portions bending inward and approaching to the soldering portions of two outermost contacts along the longitudinal direction of the insulating housing, wherein each locking member defines an outermost periphery and each board-retaining member does not exceed beyond the outermost periphery of the locking member; and wherein each locking member defines an outermost periphery and each board-retaining member does not exceed beyond the outermost periphery of the locking member.

2. The card edge connector as described in claim 1, wherein the retaining portion is shaped with a first stabbing portion and a second stabbing portion inserted in the housing.

3. The card edge connector as described in claim 1, wherein the locking member comprises a metallic arm and the board retaining portion integrally extends from the metal arm.

4. The card edge connector as described in claim 1, wherein the board-retaining portions each defines a notch therein opening toward each other.

5. A stacked card edge connector assembly comprising:

a higher card edge connector comprising an insulative housing with end portions along a longitudinal direction thereof, a plurality of contacts, a pair of locking members extending perpendicularly from the end portions and a pair of board-retaining members retained on the connector, the insulating housing defining an inserting slot in the longitudinal direction and located between the end portions and the contacts being located at two sides of the inserting slot, a cavity being formed under the locking members; and a lower card edge connector received in the cavity and in front of the higher card edge connector, the lower card edge connector separated from the higher card edge connector with therebetween a separating space in a front-to-rear direction;

wherein each of the board-retaining members of the higher card edge connector comprises a board-retaining portion extending into the separating space, and the board-retaining portions are disposed between the end portions of the higher card edge connector and corresponding end portions of the lower card edge connection on the front-to-rear direction.

6. The card edge connector as described in claim 5, wherein the retaining portions are retained in the end portions and the board-retaining portions extend inwards beyond an inner face of the end portions.

7. The card edge connector as described in claim 5, wherein the retaining portions integrally extend from the locking members and the board-retaining portions extend inwards beyond an inner face of the end portions.

8. An electrical connector assembly comprising:

lower and upper connectors arranged essentially under a stacked manner in a vertical direction;

the lower connector including:

a lower housing defining a horizontal lower module receiving slot, which extends in a lengthwise direction perpendicular to said vertical direction, with lower contacts by two sides of the lower module receiving slot in the vertical direction, a pair of lower module locking members located at two opposite ends of the lower housing in said lengthwise direction for locking a module received in the lower module receiving slot; and a pair of lower board retaining members around said two opposite ends of the lower housing with corresponding soldering pads horizontally extending inwardly in the lengthwise direction toward each other;

the upper connector including:

an upper housing, which is higher than the lower housing in the vertical direction, defining a horizontal upper module receiving slot, which extends in said lengthwise direction, with upper contacts by two sides of the upper module receiving slot in the vertical direction, a pair of upper module locking members located around two opposite ends of the upper housing in said lengthwise direction for locking an upper module received in the upper module receiving slot; and a pair of upper board retaining members around the said two opposite ends of the upper housing with corresponding soldering pads horizontally extending inwardly in the lengthwise direction toward each other;

the pair of upper module locking members defining cutouts thereunder to receive the pair of corresponding lower module locking members, respectively; wherein the soldering pads of the pair of upper board retaining members are configured to be large enough to be exposed upwardly to an exterior in a space between the upper housing and the lower housing for inspection, wherein the upper module locking members are equipped with the corresponding stopper arms on outer sides of the upper module locking members for preventing over-outward-deflection of the upper module locking members, while the lower module locking members are equipped with the corresponding stopper arms on under sides of the lower module locking members for preventing over-outward-deflection of the lower module locking members.

9. The electrical connector assembly as claimed in claim 8, wherein the upper board retaining member is unitarily formed with the corresponding upper module locking member.

10. The electrical connector assembly as claimed in claim 8, wherein the soldering pad of the upper board retaining member is essentially fully exposed upward to the exterior.

11. The electrical connector assembly as claimed in claim 8, wherein said space extends in both the lengthwise direction and the front-to-back direction.

* * * * *